US006024779A

United States Patent [19]

Snell

[11] Patent Number: 6,024,779

[45] Date of Patent: Feb. 15, 2000

[54] METHOD OF PROTECTING COPPER MELT FROM OXIDATION WITH CARBON SAND

[75] Inventor: Michael C. Snell, Palatine, Ill.

[73] Assignee: AMCOL International Corporation, Arlington Heights, Ill.

[21] Appl. No.: 09/126,471

[22] Filed: Jul. 30, 1998

[51] Int. Cl.[7] ..... C22B 15/00

[52] U.S. Cl. ..... 75/652; 75/305; 75/709

[58] Field of Search ..... 75/652, 352, 10.59, 75/303, 709, 646, 305

[56] References Cited

U.S. PATENT DOCUMENTS

| | | | |
|---|---|---|---|
| 2,830,342 | 4/1958 | Meyers et al. | 22/193 |
| 2,830,913 | 4/1958 | Meyers et al. | 106/38.9 |
| 5,094,289 | 3/1992 | Gentry | 164/529 |
| 5,149,498 | 9/1992 | Nilmen et al. | 420/492 |
| 5,193,604 | 3/1993 | Brugger | 164/56.1 |
| 5,215,143 | 6/1993 | Gentry | 164/529 |
| 5,366,535 | 11/1994 | Heaslip et al. | 75/305 |
| 5,688,313 | 11/1997 | Landis | 106/38.2 |
| 5,769,933 | 6/1998 | Landis | 106/38.2 |

*Primary Examiner*—Prince Willis
*Assistant Examiner*—Tima McGurthy-Banks
*Attorney, Agent, or Firm*—Marshall, O'Toole, Gerstein, Murray & Borum

[57] ABSTRACT

A method of protecting copper and copper alloys from surface oxidation on an upper melted surface while melting copper and/or copper alloys, such as bronze, using a granular carbon sand layer thereover, such as the carbon sands disclosed in this assignee's U.S. Pat. Nos. 5,215,143 and/or 5,094,289.

12 Claims, 1 Drawing Sheet

METHOD OF PROTECTING COPPER MELT FROM OXIDATION WITH CARBON SAND

FIELD OF THE INVENTION

The present invention is directed to a method of preventing the oxidation of melting and melted copper and/or melting and melted copper alloys by covering melting and melted copper and/or copper alloys with a protective layer of carbon sand.

BACKGROUND OF THE INVENTION AND PRIOR ART

Melted copper and copper-containing alloys, such as bronze, are very reactive to oxygen and become highly oxidized on any copper-containing melt surface exposed to an oxygen-containing atmosphere in contact with the melting metal. In an attempt to minimize oxidation on a copper-containing melt surface, therefore, the melt upper surface has been protected from oxidation by covering the copper melt surface with a reducing melt cover, such as a protective layer of dry charcoal, powdered graphite, flake graphite or the like. The protective layer minimizes exposure of the melted copper to oxygen in the atmosphere within a furnace or other vessel used to melt the copper-containing metal, thereby minimizing copper oxidation. The protective layer is applied to an upper surface of the melting/melted copper-containing metal in a thickness of about one millimeter to about three or four inches, usually about one to two inches.

Brugger U.S. Pat. No. 5,193,604, for example, discloses the use of borax as a protective layer over a melting copper-containing metal, and discloses that the borax can include finely divided mixtures of metals that have an affinity for oxygen, such as Mg, Li, Ce and/or can include powders of graphite and/or fire clay and/or charcoal. As disclosed in the Brugger '604 patent, the borax protective layer causes the formation of copper borides that detrimentally and adversely affect the structure of copper alloys unless the mold is cooled quickly, e.g., with water, as in the centrifugal casting method disclosed, to minimize forming copper borides.

Iron and sulfur are additional elements that one must avoid adding to the melt during the melting of copper and copper alloys to avoid the formation of copper/iron and copper/sulfur reaction products. Also, since copper bonds to silica, silica sand cannot be used as the protective melt-covering layer. The selection of a protective layer for protecting copper and copper alloys from oxidation, therefore, has been a difficult task and, therefore, the art has for the most part, used powdered or flake graphite or charcoal to form an oxidation-resistant protective layer over melting and melted copper and copper-containing metals.

The recommended melting procedure for high-conductivity copper includes the step of deliberately inducing a high oxygen content into the melt to limit the pickup of hydrogen and to oxidize impurities that are deleterious to conductivity. The copper is melted using a protective, deoxidizing cover layer, such as flake graphite. After the molten copper has reached 2300° F. (1200° C.), the furnace is turned off and the graphite covering layer is skimmed off, for example, using a graphite rod.

Equipment used to melt copper and copper alloys, such as brass and bronze, are either fuel-fired or electric. The pouring temperatures of common copper-containing alloys are shown below:

POURING TEMPERATURES OF COPPER ALLOYS

| Alloy | | | Pouring Temperature | |
|---|---|---|---|---|
| Composition | Name | No. | Deg C | Deg F |
| 88 Cu-6 Sn-1.5 Pb-4.5 Zn | Leaded tin bronze (Navy M bronze) | 2A | 1,075 to 1,250 | 1,950 to 2,300 |
| 80 Cu-10 Sn-10 Pb | High-leaded tin bronze | 3A | 1,000 to 1,225 | 1,850 to 2,250 |
| 85 Cu-15 Sn-5 Pb-5 Zn | Leaded red brass | 4A | 1,075 to 1,300 | 1,950 to 2,350 |
| 76 Cu-2.5 Sn-6.5 Pb-15 Zn | Leaded semi-red brass | 5B | 1,075 to 1,250 | 1,950 to 2,300 |
| 57.5 Cu-39.25 Zn-1.25 Fe-1.25 Al-.25 Mn | Manganese bronze (65,000 psi) | 8A | 950 to 1,100 | 1,750 to 2,000 |
| 64 Cu-26 Zn-3 Fe-5 Al-4 Mn | Manganese bronze (110,000 psi) | 8C | 975 to 1,150 | 1,800 to 2,100 |
| 88 Cu-3 Fe-9 Al | Aluminum bronze | 9A | 1,100 to 1,200 | 2,000 to 2,200 |
| 64 Cu-4 SN-4 Pb-8 Zn-20 Ni | Nickel silver (20% Ni) | 11A | 1,225 to 1,425 | 2,250 to 2,600 |
| 81 Cu-4 Si-15 Zn | Silicon brass | 13B | 975 to 1,150 | 1,800 to 2,100 |
| 96.5 Cu-2.5 Be-1.1 Ni | Beryllium bronze | . . . | 1,000 to 1,225 | 1,850 to 2,250 |

It has been found that carbon sands that have been used together with a binder to form foundry sand molds in the foundry industry, such as described in this assignee's U.S. Pat. Nos. 5,215,143 and 5,094,289, both patents hereby incorporated by reference, can be used (without a binder) to form a protective layer over copper and copper alloy melts without the formation of copper/sulfur reaction products. The carbon sands have a number of unique advantages over other materials used to date as protective coverings for copper-containing melts, such as ease of separation of the protective carbon sand layer from the melted copper-containing metal; the capability of reusing the carbon sand; the capability of remelting any copper or copper alloy removed with the carbon sand that is skimmed from the melt surface after metal melting is complete; the carbon sands are granular, thereby avoiding dust, yet provide excellent protection against copper oxidation when used at a thickness of about one millimeter up to about three or four inches. Trial tests indicate that the carbon sands transfer little to no sulfur or hydrocarbons into the copper melt, below detection capacity of the sulfur detecting apparatus, and certainly within acceptable limits, at temperatures as high as 2500–3000° C., and probably at higher temperatures, e.g., 4000° C.

SUMMARY OF THE INVENTION

In brief, the present invention is directed to a method of protecting copper and copper alloys from surface oxidation on an upper melted surface while melting copper and/or copper alloys, such as bronze, using a granular carbon sand layer thereover, such as the carbon sands disclosed in this assignee's U.S. Pat. Nos. 5,215,143 and/or 5,094,289.

Accordingly, one aspect of the present invention is to provide a new and improved method of protecting melted and melting copper and/or copper-containing alloys from oxidation by covering the melted or melting copper or copper-containing alloys with a protective layer of carbon sand that has been heat treated or calcined for removal of volatilizable hydrocarbons at a temperature of at least about 1000° F.

Another aspect of the present invention is to provide a new and improved carbon sand covering material for protecting melted copper and copper alloys from oxidation, said carbon sand covering material being capable of reuse and having a new and unexpected capability of being separated from the melted copper and copper alloys for recovery of the copper-containing metal and reuse of the carbon sand.

The above and other aspects and advantages of the present invention will become more apparent from the following detailed description of the preferred embodiments, taken in conjunction with the drawings.

DETAILED DESCRIPTION OF THE PREFERRED EMBODIMENTS

Figure 1:
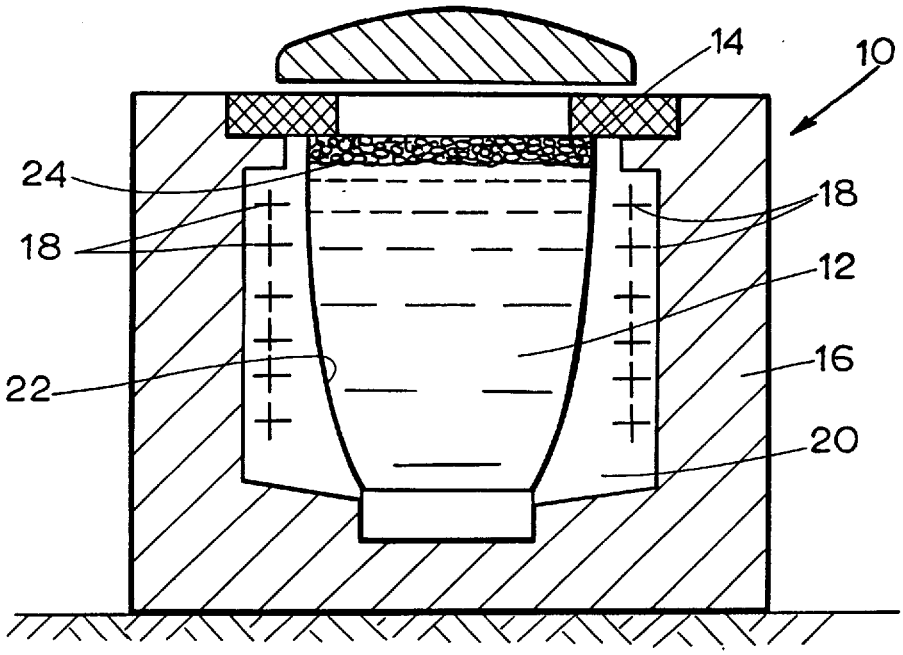
FIG. 1 is a cross-sectional view of a typical induction furnace used to melt copper and copper-containing alloys, including a covering layer of carbon said.
Figure 2:
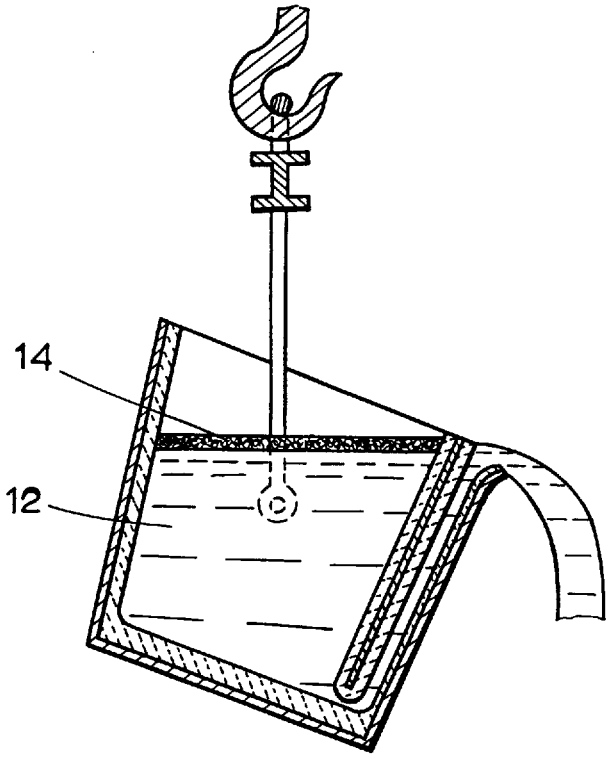
FIG. 2 is a cross-sectional view of a typical teapot-type ladle, including a covering layer of carbon sand, used to pour melted copper and copper alloys.

The preferred protective layering material, in accordance with the principles of the present invention, is the essentially non-porous carbon sand disclosed in the Gentry U.S. Pat. No. 5,215,143, sold as CAST-RITE® sand to the foundry industry. This carbon sand comprises coke particles manufactured by calcining or roasting a petroleum oil, in the presence and/or absence of oxygen, at a temperature in the range of about 1900° F. to about 2300° F. to separate the oil into hydrocarbon vapors and spherical or ovoid coke particles (carbon sand). Any fluid coke resulting from a petroleum refining process which is heat treated or roasted at a temperature of at least about 1000° F., preferably at a temperature of at least about 1200° F., and more preferably to a temperature of about 1900° F. to about 2300° F. until the fluid coke ceases to emit volatilized gases provides an effective melted copper oxidation barrier without adding excessive sulfur to the copper melt. The fluid coke should be heat treated for a time sufficient to volatilize the organic contaminants, particularly any sulfur-containing compounds, that volatilize at the temperature of the melted copper or copper alloys.

Turning now the to the drawing, there is shown a typical induction furnace 10 for melting copper and copper alloys, shown containing melted copper or copper alloy 12 and a protective layer of carbon sand 14 floating on top of the melted copper-containing metal 12. Typical induction furnaces include temperature-resistant insulating material 16 surrounding a copper induction coil 18. A refractory lining 20 is disposed between the induction coil 18 and a molten metal receptacle 22. When the coil 98 is electrically energized, electric energy is induced into the metal 12 where it builds up heat in the metal until the metal melts and becomes superheated. It should be understood that the induction furnace 10 is shown for illustration purposes only and that any type of heating means or furnace, such as a fuel-fired furnace, a crucible or pit furnace, a rotary furnace, a reverberatory furnace, an electric furnace, an indirect-arc furnace, or resistance furnace can be used to melt the copper-containing metal 12, as well known in the art.

The protective covering layer 14 used to prevent excessive oxidation of the upper surface 24 of the melted copper-containing metal 12 is a carbon sand, preferably having a granular size distribution such that at least about 90% by weight of the carbon sand particles have a size between about 20 mesh, U.S. Sieve Series, and about ½ inch in diameter. The preferred carbon sand particles are spherical or ovoid and are obtained by calcining a fluid coke derived from petroleum oil refining, called fluid coke.

The calcining temperature in rotary kilns used to process fluid coke carbon sands is maintained by the burning of both the volatile hydrocarbon gases evolving from the coke and the carbon coke particles. A carbon sand (CAST-RITE 75) of American Colloid Company is being produced by calcining fluid coke at about 2200° F. to about 2300° F.

U.S. Pat. Nos. 2,830,342 and 2,830,913, hereby incorporated by reference, also describe carbon sands prepared by calcining fluid coke. These carbon sands also are suitable as a protective layer over melting copper-containing metals in accordance with the present invention.

Spherical or ovoid grain, carbon or coke particles, known to the trade as petroleum fluid coke, have been used as foundry sands where silica sands and olivine sands do not have the physical properties entirely satisfactory for casting metals such as aluminum, copper, bronze, brass, iron and other metals and alloys. Such a fluid coke carbon sand presently is being sold by American Colloid Company of Arlington Heights, Ill. under the trademark CAST-RITE® carbon sand. The preferred CAST-RITE® carbon sand typically has the following particle size distribution, having more than 95% by weight of the particles with a size larger than 1680 $\mu$m:

| U .S. Sieve Number | Oversize |
|---|---|
| 0.375 in. | 8.6% |
| 0.250 in. | 41.3% |
| 4 | 13.9% |
| 6 | 19.9% |
| 12 | 13.7% |
| 20 | 1.4% |
| 30 | 0 |
| 40 | 0 |
| 50 | 0 |
| 70 | 0 |
| 100 | 0 |
| 140 | 0 |
| 200 | 0 |
| 270 | 0 |
| Pan | 1.2% |

Roasted carbon sand as described in U.S. Pat. No. 5,094,289, is a low cost carbon sand designed primarily for low melting temperature metals, such as aluminum and magnesium and is suitable as a protective covering layer during the melting of a copper-containing metal in accordance with the method of the present invention. Roasting at 1300–1400° F. will remove all of the volatile matter which would otherwise be evolved if raw fluid coke were exposed to aluminum poured at 1400° F. Likewise, thermal expansion would be minimal at 1400° F.

Obviously, many modifications and variations of the invention as hereinbefore set forth can be made without departing from the spirit and scope thereof, and, therefore, only such limitations should be imposed as are indicated by the appended claims.

What is claimed is:

1. A method of melting a copper-containing metal while reducing oxidation on an upper surface of the melted metal comprising:

disposing a solid copper-containing metal in a vessel;

heating said copper-containing metal to a melting temperature of said metal to melt said metal;

covering said melted metal with a layer of carbon sand to reduce oxidation on an upper surface of said melted metal; and removing said layer of carbon sand from said upper surface of said melted metal.

2. A method in accordance with claim 1 further including the steps of:

allowing melted metal removed with the carbon sand to drain from said carbon sand and solidify; and re-melting said solidified metal.

3. A method in accordance with claim 2, further including the step of re-using the carbon sand as an upper surface layer during melting another batch of a copper-containing metal.

4. A method in accordance with claim 2, wherein the carbon sand is a petroleum-derived fluid coke heated at a temperature of at least about 1000° F. for a period of time until gas evolution from the carbon said ceases.

5. A method in accordance with claim 4, wherein the carbon sand has a spherical or ovoid particle shape and has a particle size distribution such that at least 90% of the carbon sand particles have a size in the range of 20 mesh, U.S. Sieve Series, to about 0.5 inch.

6. A method in accordance with claim 4, wherein the fluid coke is heated at a temperature in the range of about 1000° F. to about 1500° F.

7. A method in accordance with claim 4, wherein the fluid coke is heated at a temperature in the range of about 1900° F. to about 2300° F.

8. A method in accordance with claim 4, wherein the fluid coke is heated at a temperature of at least about 1950° F.

9. A method in accordance with claim 2, wherein the layer of carbon sand has a thickness in the range of one millimeter to about four inches.

10. A method in accordance with claim 2, wherein the metal is copper.

11. A method in accordance with claim 2, wherein the metal is a copper alloy.

12. A method in accordance with claim 11, wherein the metal is bronze.

* * * * *